United States Patent [19]

Symons et al.

[11] 4,388,555

[45] Jun. 14, 1983

[54] GYROTRON WITH IMPROVED STABILITY

[75] Inventors: Robert S. Symons, Los Altos; Howard R. Jory, Menlo Park, both of Calif.

[73] Assignee: Varian Associates, Inc., Palo Alto, Calif.

[21] Appl. No.: 241,880

[22] Filed: Mar. 9, 1981

[51] Int. Cl.[3] ..... H01J 25/00

[52] U.S. Cl. ..... 315/4; 315/3; 315/5

[58] Field of Search ..... 315/3, 4, 5

[56] References Cited

U.S. PATENT DOCUMENTS

| | | | |
|---|---|---|---|
| 3,183,399 | 5/1965 | Pantell | 315/4 |
| 3,259,786 | 7/1966 | Phillips | 315/3 |
| 3,463,959 | 8/1969 | Jory et al. | 315/5 |
| 4,224,576 | 9/1980 | Granatstein et al. | 315/5 |

*Primary Examiner*—Saxfield Chatmon, Jr.

*Attorney, Agent, or Firm*—Stanley Z. Cole; Richard B. Nelson

[57] ABSTRACT

In a gyrotron microwave tube, electromagnetic leakage through beam-transmitting drift tubes is greatly reduced by making the diameter of the drift tubes in centimeters less than 8.8 divided by f where f is the operating frequency in gigahertz.

8 Claims, 2 Drawing Figures

GYROTRON WITH IMPROVED STABILITY

DESCRIPTION

1. Field of the Invention

The invention pertains to microwave vacuum tubes of the "gyro-device" type in which a beam of charged particles (usually electrons) travel in helical paths as guided by a magnetic field along the helix axis. The beam passes through a wave-supporting circuit where the transverse velocity components of the particles interact with a transverse electric field component of the wave to produce amplification of the wave. The wave may be a traveling wave for a "gyro-TWT" or a standing wave in a resonant circuit for a "gyro-monotron (gyrotron) or gyro-klystron." In present-day tubes the wave is usually in a mode having circular electric field lines perpendicular to the helix axis.

2. Prior Art

Gyro-devices have become the outstanding devices for generating high power at very high frequency. This is basically because the wave-supporting circuit can have dimensions which are large compared to the free-space wavelength. The periodicity of beam-wave interaction is supplied by the periodic motion of the beam particles, so the circuit need not have the fine-scale mechanical periodicity of the traveling wave tube circuit. For the usual $TE_{0n1}$ modes, even the lowest order, the $TE_{011}$ has a lower cutoff frequency consistent with a large circuit diameter. The large circuit diameter permits a large diameter electron beam, thus a high beam current and high power. Other higher-order modes have also been used.

The prior art has tried to take full advantage of the large beams and circuits to generate maximum power. The beam has been introduced into the circuit through a short drift tube which was somewhat smaller than the circuit diameter, thereby reducing the amount of wave energy lost out through the beam-entrance aperture into the circuit. However, the loss of energy still persisted, causing interference with the electron trajectories, bombardment heating of the cathode, regeneration, and dangerous microwave radiation.

SUMMARY OF THE INVENTION

The object of the invention is to provide a gyrotron microwave generator with improved stability and efficiency, and reduced back-heating and radiation.

This object is attained by making the passageway through which the beam enters the interaction cavity smaller than a critical number related to the operating frequency, whereby radiation of wave energy from the cavity out through the beam entrance passageway is greatly reduced.

DESCRIPTION OF THE PREFERRED EMBODIMENTS

Figure 1:
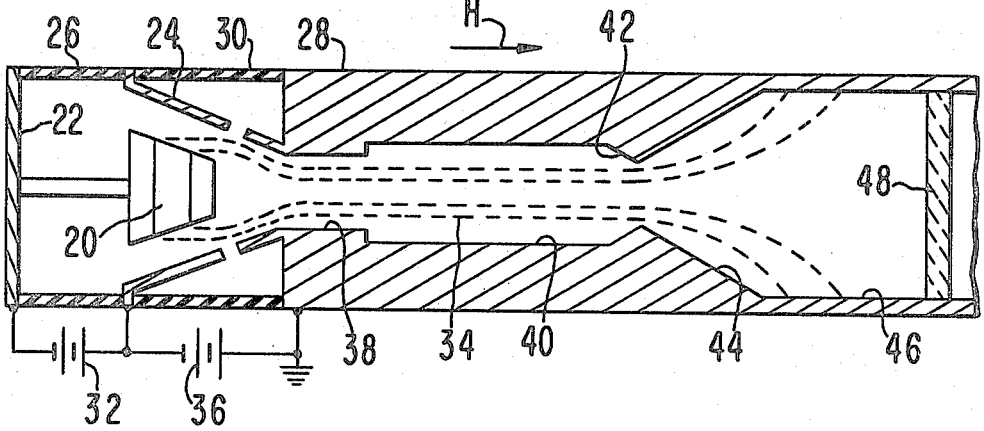
FIG. 1 is a schematic axial section of a single-cavity gyro-monotron oscillator embodying the invention.

FIG. 1 is a sketch of a gyro-device of the monotron type, or gyrotron, embodying the invention. The gyrotron is a microwave tube in which a beam of electrons having spiral motions in an axial magnetic field parallel to their drift direction interact with the electric fields of a wave-supporting circuit. The electric field in practical tubes is in a circular-electric-field mode. In the gyrotron the wave-supporting circuit is a resonant cavity, usually resonating in a $TE_{0m1}$ mode.

In the gyro-monotron of FIG. 1 a thermionic cathode 20 is supported on the end plate 22 of the vacuum envelope. End plate 22 is sealed to the accelerating anode 24 by a dielectric envelope member 26. Anode 24 in turn is sealed to the main tube body 28 by a second dielectric member 30. In operation, cathode 20 is held at a potential negative to anode 24 by a power supply 32. Cathode 20 is heated by a radiant internal heater (not shown). Thermionic electrons are drawn from its conical outer emitting surface by the attractive field of the coaxial conical anode 24. The entire structure is immersed in an axial magnetic field H produced by a surrounding solenoid magnet (not shown). The initial radial motion of the electrons is converted by the crossed electric and magnetic fields to a motion away from cathode 20 and spiralling about magnetic field lines, forming a hollow beam 34. Anode 24 is held at a potential negative to tube body 28 by a second power supply 36, giving further axial acceleration to the beam 34. In the region between cathode 20 and body 28, the strength of magnetic field H is increased greatly, causing beam 34 to be compressed in diameter and also increasing its rotational energy at the expense of axial energy. The rotational energy is the part involved in the useful interaction with the circuit wave fields. The axial energy merely provides beam transport through the interacting region.

Beam 34 passes through a drift-tube or aperture 38 into the interaction cavity 40 which is usually resonant at the operating frequency in a $TE_{0m1}$ mode. However, for the small drift tubes of the present invention, and hence the relatively small beam diameter, the transverse electric fields of $TE_{0m1}$ modes falls to zero at the axis. It then becomes attractive to use a mode with finite electric field at the axis, such as the $TE_{1m1}$. The magnetic field strength H is adjusted so that the cyclotron frequency rotary motion of the electrons is approximately synchronous with the cavity resonance. The electrons can then deliver rotational energy to the circular electric field, setting up a sustained oscillation.

At the output end of cavity 40 the inner wall of body 28 may be tapered in diameter to form an iris 42 of size selected to give the proper amount of energy coupling out of cavity 40. In very high power tubes there may be no constricted iris, the cavity being completely open-ended for maximum coupling. In either case, an outwardly tapered section 44 couples the output energy into a uniform waveguide 46 which has a greater diameter than resonant cavity 40 in order to propagate a traveling wave. Near the output of cavity 40 the magnetic field H is reduced. Beam 34 thus expands in diameter under the influence of the expanding magnetic field lines and its own self-repulsive space charge. Beam 34 is then collected on the inner wall of waveguide 46, which also serves as a beam collector. A dielectric window 48, as of alumina ceramic, is sealed across waveguide 46 to complete the vacuum envelope.

In the prior art the emphasis has been on generation of high power. The diameter of electron beam 34 was made as large as possible. Hence the diameter of beam-input drift tube 38 had to be large. It was customarily made a little smaller than the diameter of resonant cavity 40 to reduce the wave energy radiated out through aperture 38.

Applicant has found that the energy radiated by prior-art tubes is still excessive, leading to regeneration instability, loss of efficiency, and back-heating of cathode 20 by electrons accelerated by the microwave fields. There is of course some radiation through any aperture, whether or not it is large enough to propagate as a waveguide. The radiation decreases with smaller diameter and with greater length of the aperture. Prior-art apertures were designed to propagate very little energy in the operating higher-order field mode but nevertheless radiated excessively. It is possible that the excess radiation was connected with conversion to lower-order modes by small asymetries in the wave-supporting structure. Applicant has found that reducing the diameter of drift tube 38 below a critical value will drastically reduce the radiation. The critical value is related to the frequency of operation f by the relation $a<8.8/f$ where a is the diameter in centimeters and f is the frequency in gigahertz.

If the cross-section of aperture 38 is not circular, its "diameter" is not a fixed quantity as it is for a circle. However, it appears that the maximum dimension of the cross-section should be less than the above described critical value. The term "diameter" as used herein is to be understood as meaning such a maximum transverse dimension, regardless of the shape of the cross section.

Figure 2:
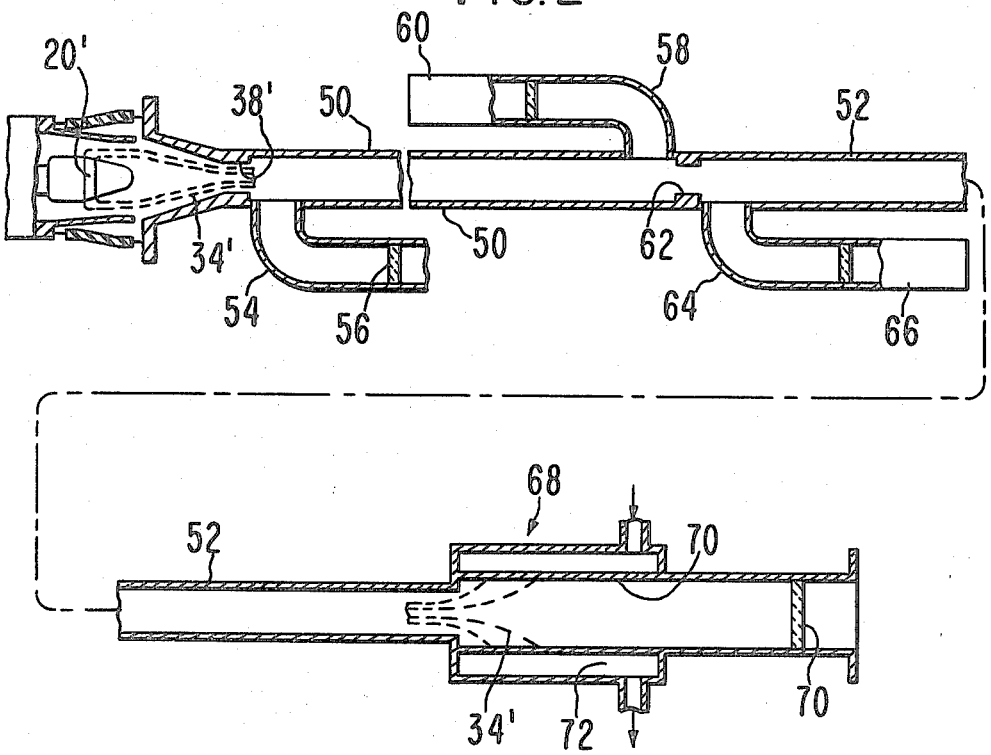
FIG. 2 is a schematic axial section of a gyro-TWT embodying the invention.

FIG. 2 is a schematic axial section of a two-section gyro-TWT. In this traveling-wave tube the interaction circuits are sections of waveguide 50, 52 which are propagating at the operating frequency. The input microwave signal is introduced into the first traveling-wave section 50 via an input waveguide 54 sealed by a ceramic window 56. The input wave travels through section 50 in a $TE_{1m}$ mode. It travels in approximate synchronism with the electron beam. The wave velocity is not equal to the axial drift velocity of the electrons as in a conventional velocity-modulated TWT; in fact in this smooth waveguide the phase velocity is faster than the speed of light. It is the transverse (circular) component of the wave's electric field which is approximately synchronous with the transverse component of the spiral electron orbits. The interaction between the beam and wave is the same as in the gyro-monotron of FIG. 1. The wave is amplified as it transits waveguide 50. It is removed by a sever waveguide 58 and absorbed in a sever load 60. The modulated beam passes through a sever drift tube or aperture 62 which is small enough that for the operating mode very little wave energy is propagated between interaction waveguides 50 and 52. The operation is completely analogous to the severs in a conventional velocity-modulated TWT. Because there is very little accidental wave feedback the overall gain may be higher than for a single-section TWT without incurring regenerative instability. Output waveguide section 52 is terminated at its input end by a sever waveguide 64 terminated in an absorptive load 66.

The modulated beam entering waveguide 52 excites the transverse-electric-field mode therein, which is amplified and transmitted through a beam-collector section 68 and an output window 70 to an external useful load (not shown). As in FIG. 1, the axial magnetic field is reduced at the entrance to collector 68 so that the hollow electron beam 34' expands and is collected on the inner wall 70. The heat generated is removed by water circulating in channels 72.

There is a problem of spurious wave energy leaking through drift tubes 38' and 62. The bad effects of radiation from input drift tube 38' were described above in connection with FIG. 1. Also, any wave energy leaking from output waveguide 52 through sever drift tube 62 back into input waveguide 50 will constitute a source of internal regeneration which can cause instability or unwanted oscillations. In accordance with the invention, both input drift tube 38' and sever drift tube 62 should have internal diameters smaller than the critical value described above, thereby greatly reducing the leakage wave energy.

The above examples are exemplary and not limiting. Other embodiments of the invention will be obvious to those skilled in the art. The invention may be applied to various kinds of fast-wave tubes and to apertures with shapes other than cylinders or other figures of revolution. The invention is intended to be limited only by the following claims and their legal equivalents.

We claim:

1. A gyro-device microwave generator comprising: means for generaing a beam of charged particles following helical paths, circuit means for supporting at a selected operating frequency an electromagnetic wave in a higher order mode having a transverse electric field component for interaction with the transverse velocity component of said particles, a wave isolating aperture on at least one end of said circuit means, said circuit means and said aperture being hollow to provide longitudinal passage of said beam, the improvement being the maximum inner diameter a of said aperture being less than 8.8/f where a is the diameter in centimeters and f is the frequency of said wave in gigahertz.

2. The gyro-device of claim 1 wherein the interior passages of said circuit means and said aperture are figures of revolution about a common axis.

3. The gyro-device of claim 1 wherein the interior passage of said aperture is not a figure of revolution and wherein said diameter is the maximum transverse dimension of said passage.

4. The gyro-device of claim 1 wherein said one end is the end of said circuit means proximate said generating means.

5. The gyro-device of claim 1 further comprising a second circuit means displaced from said circuit means in the direction of said longitudinal passage, and wherein said aperture is disposed between said circuit means and said second circuit means.

6. The gyro-device of claim 1 wherein said electromagnetic wave is a traveling wave.

7. The gyro-device of claim 1 wherein said electromagnetic wave is a standing wave and said circuit means is resonant at said frequency.

8. The gyro-device of claim 1 wherein the length of said aperture is greater than said diameter.

* * * * *